United States Patent [19]

Faulin

[11] 4,058,326

[45] Nov. 15, 1977

[54] SKI BINDINGS

[76] Inventor: Antonio Faulin, V.Giovanni da Procida 4, Milan, Italy

[21] Appl. No.: 583,027

[22] Filed: June 2, 1975

[30] Foreign Application Priority Data

June 7, 1974 Italy ..... 23711/74
Jan. 10, 1975 Italy ..... 19193/75

[51] Int. Cl.[2] ..... A63C 9/00
[52] U.S. Cl. ..... 280/617; 280/11.36
[58] Field of Search ..... 280/11.36, 611, 637, 280/617, 618, 636, 619, 620; 36/117, 118, 119, 120, 121, 89, 88

[56] References Cited

U.S. PATENT DOCUMENTS

| | | | |
|---|---|---|---|
| 3,619,914 | 11/1971 | Hanson et al. | 36/121 |
| 3,686,778 | 8/1972 | Hornung | 36/120 |
| 3,747,235 | 7/1973 | Post | 36/118 |
| 3,834,723 | 9/1974 | Erlebach | 280/613 |
| 3,854,743 | 12/1974 | Hansen | 280/618 |

FOREIGN PATENT DOCUMENTS

| | | | |
|---|---|---|---|
| 919,975 | 12/1946 | France | 280/11.36 |
| 857,006 | 11/1952 | Germany | 280/11.36 |
| 1,912,959 | 9/1970 | Germany | 280/637 |
| 417,441 | 1/1947 | Italy | 280/11.36 |

*Primary Examiner*—Joseph F. Peters, Jr.
*Assistant Examiner*—Milton L. Smith
*Attorney, Agent, or Firm*—Guido Modiano; Albert Josif

[57] ABSTRACT

A ski binding that comprises an element for gripping the skier's leg, a base rigidly connected to the ski and a rigid elongated element for mechanically connecting the gripping element and the base, this element being pivotally connected to the base for rotation about an axis perpendicular to the longitudinal axis of the ski and parallel to the surface of the ski.

9 Claims, 17 Drawing Figures

19

2
3
22
1
7
6
21
4
12
23
9
5
8
20
19
14
16
16
11
17
15
13

53
52
51

60
56
59
102
55
54
103
58
61
101
57
106
110
107
105

108
104

SKI BINDINGS

BACKGROUND OF THE INVENTION

The present invention relates to ski bindings.

At present, the ski is connected to the skier's leg or foot by providing it with special safety bindings which fasten the ski boots firmly but in such a manner as to release them should tensile or torsional stresses or generally any stresses dangerous for the leg develop.

The ski boot, though having the specific function of marrying the skier's foot to the ski by means of his binding, for which function it is duly provided with a rigid sole specially shaped and rounded off, also has the function, as important as the preceding one, of limiting the movements of the leg, with respect to the foot, consequently with respect to the ski, thereby practically blocking, although partially, the ankle. This latter important function is undoubtedly a result of recent skiing techniques, particularly with regards to downhill and pleasure skiing equipment but has also been dictated for reasons of safety. In other words, since the ski boot has the task of carrying out these functions, which consist in the transmission of muscular forces from the leg to the ski, this has determined a shape, rigidity and weight of the ski boot such as to cause considerable discomfort to the skier. In fact presently the shape, weight and rigidity of ski boots provide serious inconveniences for the person who wears them, not only while skiing, but mainly in the event he has to walk short distances, for example when going from ski slopes to transport means or vice versa.

The object of the present invention is precisely to allow the use, for skiing, of boots having uppers and soles which are soft and flexible; in other words boots which may be utilized for skiing, though still maintaining the characteristics of normal footwear for walking, thanks to simple gadgets which do not alter in any manner their comfort or practicality.

A further object of the present invention is to provide a ski binding wherein the possibility of utilizing soft shoes eliminates the rigidity of the central portion of the ski, which is necessary when using conventional ski boots with a rigid sole; consequently, the flexibility and the elasticity of the ski is increased thus obtaining remarkable improvements even in competitive skiing.

Another object of the present invention is to provide a ski binding which allows to exploit the skier's articulations, that is it provides the possibility of utilizing, during skiing, the articulations of the foot and of the leg with the freedom to elastically limit the movements of the articulations, thus also obtaining a better and more effective transmission of muscular stresses imparted from the leg to the ski.

A further object of the present invention is to provide a ski binding which may be easily and rapidly folded on the ski itself, so as to limit its bulkiness and to facilitate transport.

A further object of the present invention is to provide a ski binding structure which can replace the high and rigid binding-boot assembly presently used and achieve its functions in a more effective and practical manner and above all with a greater safety for the skier.

SUMMARY OF THE INVENTION

These and other objects, which will be more apparent hereinafter are attained by the device according to the present invention, characterized in that it comprises an element for gripping the skier's leg, a base rigidly connected to the ski and means for mechanically connecting said gripping element and said base, said means being pivotally connected to the base for rotation about an axis perpendicular to the longitudinal axis of the ski and parallel to the plane thereof.

BRIEF DESCRIPTION OF THE DRAWINGS

Further characteristics and advantages of the invention will be more evident from the description of a few preferred but not exclusive embodiments of the device, illustrated by way of non-limiting examples in the accompanying drawings, in which.

DESCRIPTION OF THE PREFERRED EMBODIMENTS

Before proceeding with the description of the ski binding according to the invention, it appears useful to examine the movements of the foot and of the leg of the skier with respect to the ski, with reference to the equilibrium position, keeping in mind the various positions which are assumed while skiing as well as the safety involved for various possible manners of falling.

The shifting of the foot in a longitudinal direction with respect to the ski is harmful during downhill skiing and during walking sliding manoeuvre, this latter manoeuvre being hereinafter simply called "walking". A backward sliding movement of the foot is on the other hand useful in the case of a forward fall or torsion of the leg with respect to the ski.

The horizontal rotation of the foot in both directions, that is about an axis substantially perpendicular with respect to the plane of the ski, is harmful both in downhill skiing and in walking, whereas it is useful in the case of a forward fall and is absolutely necessary in the case of torsion of the leg with respect to the foot.

The longitudinal oscillation, of the foot about a horizontal axis perpendicular to the longitudinal axis of the ski, of the foot about the big toe articulation is useful during downhill skiing, and necessary during walking, and is in addition necessary in the case of a forward fall and useful in the case of torsion.

The transversal oscillation of the leg, that is about an axis substantially parallel to the longitudinal axis of the ski is absolutely dangerous both in downhill skiing and in walking, whereas it is without effect in the case of a forward fall and torsion of the leg with respect to the foot.

The forward longitudinal oscillation of the leg, that is about a horizontal axis perpendicular to the longitudinal axis of the ski passing through the ankle, is useful in the case of downhill skiing, necessary in walking, necessary in the case of a forward fall and useful in the case of torsion.

The backward longitudinal oscillation of the leg is not useful in the case of downhill skiing, is hardly useful in walking, is practically without effect in the case of a forward fall and torsion.

The shifting of the front part of the sole of the foot from the ski is absolutely harmful in the case of downhill skiing and walking, whereas it is useful in the case of a forward fall and necessary in the case of torsion.

As for the eventuality of a backward fall, all the mentioned movements are practically indifferent except for the backward longitudinal oscillation of the leg which is not advantageous.

Figure 1:
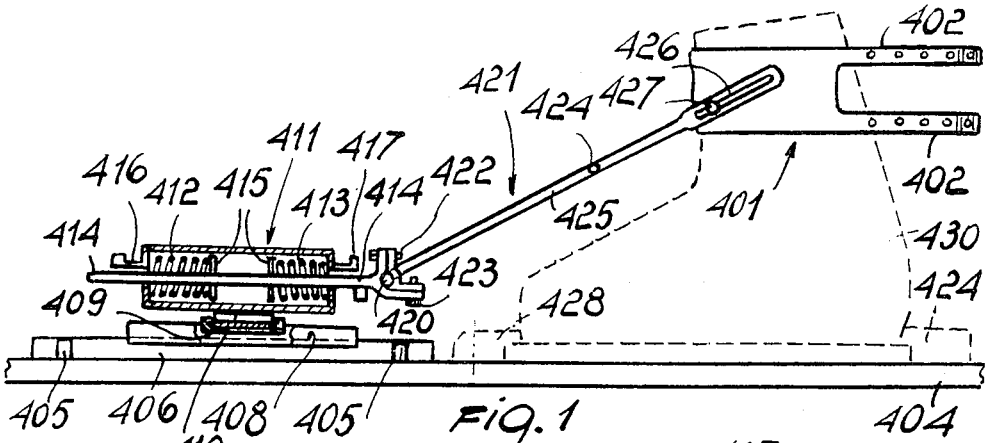
FIG. 1 is a lateral view of a first embodiment of the ski binding with parts partially broken away.
Figure 2:
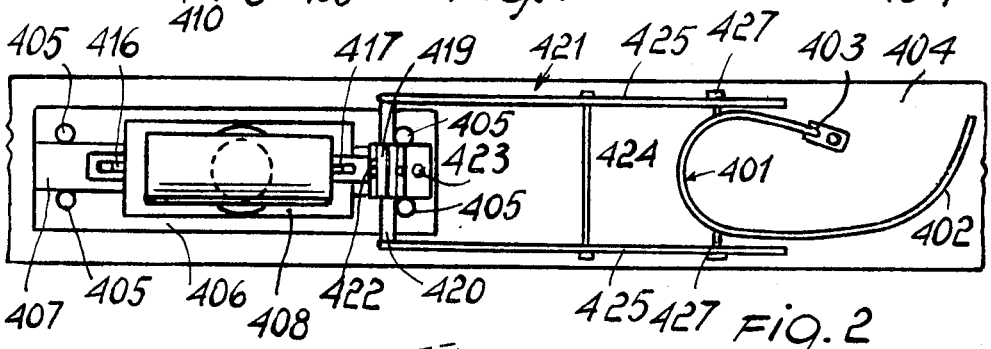
FIG. 2 is a plan view of the binding of FIG. 1.

With reference to FIGS. 1 and 2, the binding comprises firstly a sleeve-like band 401, provided with two fastening straps 402 both of which engage with a buckle 403. A base plate 406 provided with a longitudinal guide 407 is attached to the ski 404 by means of screws 405. A slide 408 slides on said guide 407 thereby being adjustable to the most suitable position. The slide 408 bears on its upper portion a circular cavity 409 housing a plate 410 engaged therein on which a shock absorber 411 is fixed. The shock absorber 411 may thus perform slight horizontal rotations with respect to the slide 408, so as to be centered in the most suitable position. The shock absorber 411 houses a front helical spring 412 and a rear helical spring 413, coaxial with the stem 414 of the shock absorber 411. Two piston valves of the shock absorber 411 are indicated at 415. This shock absorber is also provided with an appendix 416, to avoid the rotation of the stem 414, and with an adjustable limit stop 417 for the stem 414, which has a stop pin 418. The stem 414 ends in a transversal sleeve 419, internally housing a pin 420 which is part of a U-shaped connecting element 421 between said stem 414 and said band 401. Two pins in the shape of screws respectively 422 and 423 are provided on said transversal sleeve 419, since the sleeve may be disassembled into two elements clearly represented in the figure. Advantageously this U-shaped element 421 is provided with a bar 424 for regulating the relative distance between the rods 425 of the element 421 itself. Each rod 425 of the U-shaped element 421 is provided with a straight guide slot 426, in which pins 427 for connecting said U-shaped element 421 to said sleeve-like band 401 may slide and be secured in the required position. In addition, a toe attachment 428 and a heel attachment 429 are provided for the ski boot 430, as clearly seen in FIG. 1.

Figure 3:
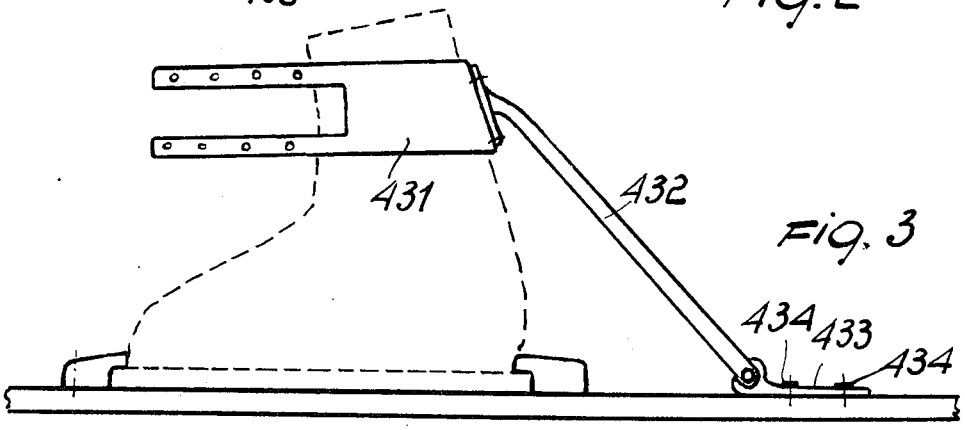
FIG. 3 is a lateral view of a second embodiment of the binding.
Figure 4:
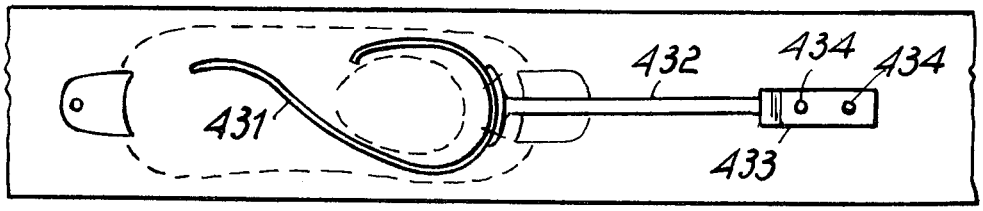
FIG. 4 is a plan view of the binding of FIG. 3.

Another possible embodiment of the binding is represented in FIGS. 3 and 4. The representation is schematic, but sufficient for understanding the structural arrangement as well as the operation of the binding, which is nothing else than a different embodiment of the binding of FIGS. 1 and 2. The numeral 431 indicates a sleeve-like band entirely analogous to the band 401. This band 431 grips the leg and is connected by means of a rod 432 to a base plate 433 fixed to the ski with screws 434, behind the ski boot. The operation of the binding, partially evident from the foregoing details about the structural assembly, may however thus be briefly summarized: once the boot 430 has been attached to the ski 404 by means of the toe attachment 428 and the heel attachment 429, the band 401 (or 431) surrounds the leg at a height, variable according to requirements, between the ankle and the knee. The muscular force is thus discharged on the ski 404 instead of through the boot 430 (whose function in this case is essentially to cover and protect the foot), through the U-shaped element 421 (or through the rod 432); the shock absorber 411 has the function of transmitting more slowly stresses from the leg to the ski and vice versa.

Figures 5, 6, 7, 8:
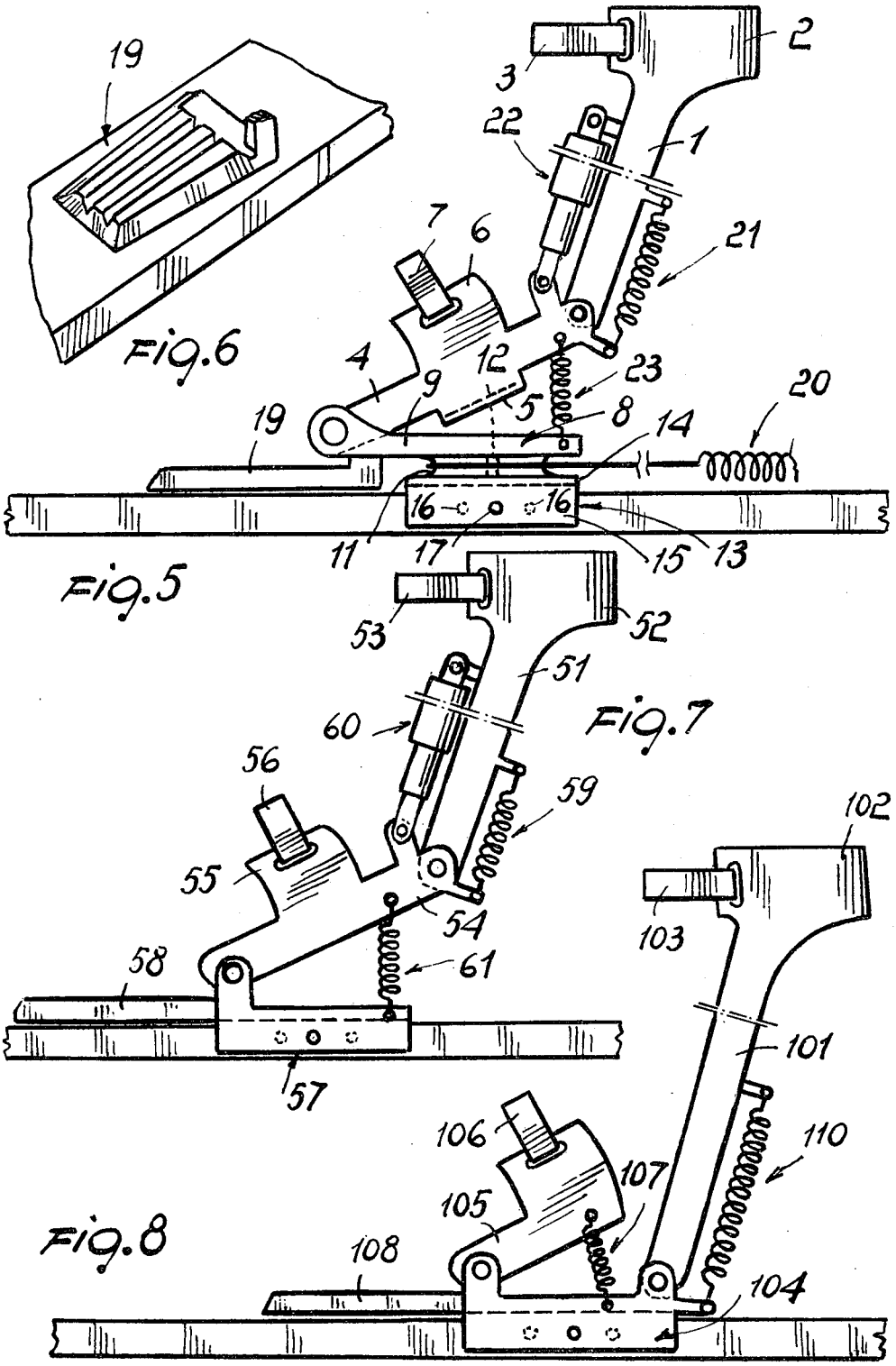
FIG. 5 is a diagrammatic representation of a third embodiment of the binding according to the invention.
FIG. 6 is one of the possible embodiments of a plate-like element of the binding.
FIG. 7 is a diagrammatic representation of a fourth embodiment of the structure of the binding according to the invention.
FIG. 8 is a diagrammatic representation of a fifth embodiment of the binding structure.

With reference to FIGS. 5 and 6, the ski binding comprises a first rigid elongated element 1 laterally engageable to the leg of a skier at the shin-bone; more precisely, the first elongated element 1 may consist of a rigid lever, a metallic tube or any elongated element which gives sufficient guarantees of rigidity, and in addition is preferably arranged on the outside lateral portion of the leg in such a manner that, during skiing, it does not strike against the corresponding element associated to the other leg; obviously, if necessary it is possible to arrange two elongated elements 1 laterally to the leg, one on the inside and the other on the outside.

The first elongated element 1 has close to its upper end a shaped portion 2 peripherically embracing, to a certain extent, the calf of the skier. An upper strap 3, which surrounds the calf, is connected to the shaped portion 2, which has two holes for receiving the strap in a manner preventing the upper strap 3 from rotating about the elongated element 1. Advantageously, means for adjusting the height of the upper strap 3 with respect to the elongated element 1 are provided on the upper end of the first elongated element 1.

The binding moreover comprises a second element for embracing the metatarsus of the foot, this element consisting, according to the present embodiment, of a substantially horizontal lever 4 arranged laterally to the foot of the skier, on the side of the first elongated element 1, and provided with a lower plate 5 which is arranged under the foot of the skier at the arch of the foot itself.

At its rear end the lever 4 is articulated to the lower end of the elongated element 1; the articulation is obtained by means of a pin which joins the element 1 to the lever 4 for rotation about a horizontal axis perpendicular to the longitudinal axis of the ski and passing through the ankle of the skier's foot.

In a central portion of the lever 4 there is provided a lateral element 6 shaped for contacting the lateral portion and a section of the upper portion of the metatarsus of the skier's foot. In addition there is provided a band 7 connected to said lateral element 6 which contacts the upper portion of the metatarsus of the foot and is arranged to maintain a tight adhesion of the skier's foot to the lower plate 5.

At its front end said lever 4 is articulated to a rotating plate element indicated overall at 8, which is situated below said lower plate 5. More precisely, the front extremity of the lever 4 is pivotally connected to a projection 9 extending in front of said rotating plate element 8, by means of a horizontal pin. This horizontal pin allows the rotation of the lever 4, and consequently of the second element 6 involving the metatarsus of the foot, about a horizontal axis perpendicular to the longitudinal axis of the ski, and therefore parallel to said axis of rotation of elongated lever 1, passing close to the big toe articulation of the skier's foot.

Below the rotating plate element 8 there is provided a disc 10, rigid to the element 8, having a peripheral circular groove 11 and rotatably engaged, by means of a vertical pin 12 passing through the center of the disc 10, to a base element 13, which is attached to the ski and has the function of connecting the binding to the ski. More precisely, said base element 13 consists of a bridge element 14 having lateral portions 15 bent downwards and laterally engaging the ski; these lateral portions 15 have a number of spaced through holes 16 for engaging a locking rod 17, passing through a transverse hole provided on the neutral axis of the ski. It is evident that with this arrangement, by inserting the locking rod 17 in one of the holes 16 and in the transverse cavity provided in the ski, a stable anchoring of the bridge element 14 to the ski is possible; it is emphasized that by having provided the transverse cavity on the neutral axis of the ski, the ski has not been weakened by applying to it the bridge element. It is added in fact that the use of conventional screws or nails passing through the upper face of the ski may in some instances weaken the ski and cause its breakage in the case of considerable stresses.

A pair of cables extend in the groove 11 provided peripherically on the disc 10, one clockwise and the other anticlockwise around the disc, and are fixed at one end in cavities provided on the disc and at the other end join up to an elastic element generally indicated at 20 which has the function of elastically opposing rotations of the rotating element 8 about the vertical pin 12. The rotating binding arrangement, which is not described in detail in that it is known per se, has the function of maintaining the foot straight during operating conditions, allowing however, in case of necessity, elastically limited rotations about the pin 12, which is preferably arranged close to the axis of the shin-bone. In addition to what has been said, projection 9 is connected to a plate element 19 (better illustrated in FIG. 6), having a preferably trapezoid shape with the lower base arranged forwardly and having inclined lateral sides. The plate-like element 19 has a shaped upper surface matingly engageable with a conjugated recess provided on the sole of the skier's footwear and having the function of preventing movements of the sole with respect to the binding and consequently to the skier's foot. As shown in FIG. 6, the upper surface of the plate-like element 19 may be provided with longitudinal grooves.

The rotation of the first elongated element 1 with respect to the lever 4 occurs against the action of a first elastic element like a spring 21, operating preferably by tension, and a shock absorbing element 22, operating by tension and by compression, which has the function of aiding with the physiological system of the articulations, tendons and muscles, in transmitting impulses to the ski and in controlling the impulses that the latter transmits to the limb. A second elastic element like a spring 23, is arranged between the lever 4 and the rotating plate element 8 and has the function of elastically opposing forward rotations, about an axis also horizontal, of the lever 4 with respect to the rotating plate element 8.

The operation of the above described binding will now be examined. First of all, it is observed that the phalanxes of the foot are held against the ski directly, thus allowing a considerable sensitiveness; the metatarsus may articulate to its full extent on the phalanxes and so the shin-bone on the metatarsus (it being always possible to limit the extent of these movements by means of the previously described elastic means and/or eventually pins).

On the other hand any lateral oscillation of the tarsus and of the metatarsus with respect to the shinbone is completely blocked, thus allowing a perfect control of edging. The action of the elastic and shock absorbing elements allows loading on the tips and on the tails.

A considerable degree of safety is thus achieved in that any possibility of inconveniences is eliminated since, as previously mentioned, the binding can follow all the natural articulations of the leg and foot, thus avoiding dangerous strains.

In addition it is emphasized that, since the plate-like element 19 is connected to the projection 9 of the rotating element 8, it is allowed to rotate, together with the rotating element 8, with respect to the ski in the case of torsion of the leg with respect to the ski itself, while it prevents backward shifting of the foot and lateral oscillations of the foot with respect to the ski during normal conditions of use.

A fourth embodiment of the invention is illustrated in FIG. 7. According to this embodiment, the binding has a first elongated element 51, completely analogous to the elongated element 1 previously described, having a shaped portion 52 at one end to which is connected an upper band 53, embracing the skier's leg at the calf. The elongated element is articulated at the other end to the rear end of a lever 54, completely analogous to the aforementioned substantially horizontal lever 4, which is arranged laterally to the skier's foot on the side provided with the elongated element 51; the rotation of the element 51 with respect to the lever 54 is possible about a horizontal axis perpendicular to the longitudinal axis of the ski. In front, the lever 54 is articulated to a base element 57 about a horizontal axis perpendicular to the longitudinal axis of the ski and passing close to the big toe articulation of the foot. The base element 57 is secured to the ski. In a central portion, the lever 54 has a lateral element 55 extending substantially upwards and shaped in such a manner as to involve the lateral part and eventually a section of the upper portion of the metatarsus. There is also provided a substantially elastic band 56 connected to the free end of the element 55 and which has the function of enveloping the remaining portion of the metatarsus and of maintaining a tight adhesion of the foot to the ski. The mentioned base element 57 has a completely analogous shape and achieves the same function as the base element indicated at 13 in the previously described embodiment. A plate-like element 58, analogous to and achieving the same function as the previously described plate-like element 19, is connected to the front portion of the base element 57.

Also in this embodiment there are provided first elastic means 59 acting mainly by tension between the elongated element 51 and the lever 54 and shock absorbing means 60, also acting between the element 51 and the lever 54 and operating mainly by compression; in addition there are provided second elastic means 61, also operating by tension, provided between the base element 57 and the lever 54; the second elastic means contribute to the adhesion between the skier's foot and the ski. With the described embodiment the binding allows a forward bending even up to 90°, overcoming the action of the elastic means 59 and 61 and compressing the shock absorbing element 60; as for the torsion of the foot with respect to the leg, it happens that in case of dangerous stresses, the elastic resistance offered by the elastic band 56 is overcome thus resulting in the release of the foot from the binding. The peripherally inclined sides of the plate-like element 58 cause, in case of torsion, the recess of the sole in which the plate-like element 58 is engaged to be raised with respect to the plate-like element thus allowing disengagement.

It should also be noted that the elastic band 56 may eventually be replaced by hooks with automatic release known per se, or by any other element that above a certain degree of stress opens up, thus releasing the foot from the binding.

In the fifth embodiment illustrated in FIG. 8, the binding comprises a first rigid elongated element 101 which may be connected to the skier's leg at the shin-bone and which has an upper end provided with a shaped portion 102 enveloping the leg to a certain extent at the level of the calf and having holes for receiving a band 103 which envelops the calf and which is connected to said shaped portion 102. At its lower end this elongated element 101 is articulated to a base element 104 associated to the ski and similar to the base elements previously described. The element 101 is rotatable about an axis substantially perpendicular to the longitudinal axis of the ski and parallel to the plane of the ski, this rotation occurring against the action of a first elastic means in form of a spring 110 provided between said element 101 and said base element 104 and operating mainly by tension. At the front portion of said base element 104, close to the big toe articulation of the skier's foot, there is articulated a second element 105, involving the metatarsus of the foot, to which is connected an elastic band-like element 106 which contacts the metatarsus for the remaining extent and which in cooperation with second elastic means in form of a spring 107 acting between the element 105 and the base element 104 achieves the adhesion of the foot to the ski, and more precisely of the sole of the footwear worn by the skier to the ski; these second elastic means 107 also operate mainly by tension. The rotation of the element 105 with respect to the base element 104 against the action of said second elastic means occurs about an axis perpendicular to the longitudinal axis of the ski and parallel to the plane of the ski.

The rigid elongated element 101 may be arranged, as already described for the corresponding elements 1 and 51 of the preceding embodiments, laterally of the skier's leg for rotation in a plane parallel to the vertical plane of symmetry of the ski.

A plate-like element 108 analogous to the preceding ones and achieving the same function, extends in front of the base element 104 rigid therewith.

With the binding structure just described, it is possible to have a forward rotation of the foot and shinbone by overcoming the elasticity of the described elastic means and also in this case there is a shifting of the upper band 103 with respect to the leg.

As for the torsion of the foot with respect to the leg, the stresses imparted by the ski above a predetermined value overcome the elastic resistance of the band 106, thus releasing the foot from the binding. It should be remembered once again that in this case, as in the preceding ones, the rigid elongated element 101 prevents transversal oscillations of the shin-bone with respect to the foot, that is with respect to an axis parallel to the longitudinal axis of the ski.

Figure 9:
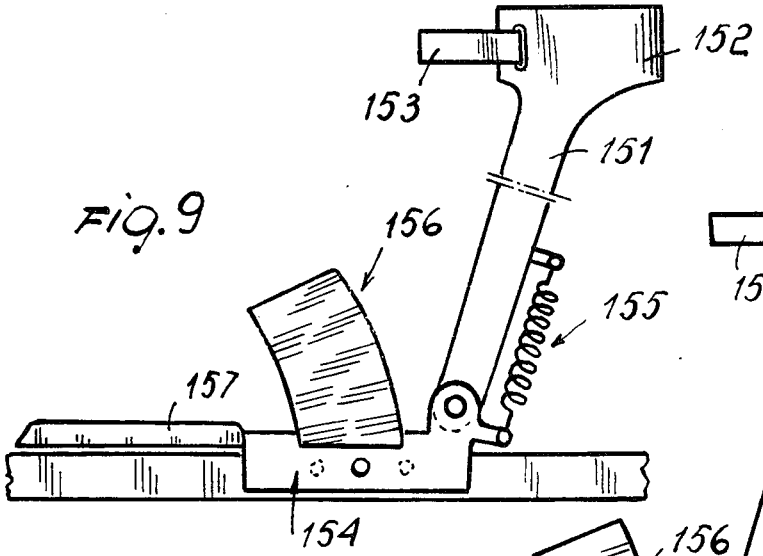
FIG. 9 is a diagrammatic representation of a sixth embodiment.

A sixth embodiment is shown in FIG. 9. It is provided with a rigid elongated element 151 which may be associated to the skier's leg at the shin-bone and having, as in the preceding cases, a one end provided with shaped portion 152 and an upper band 153 which embraces the calf. The elongated element 151 is articulated at the other end to a base element 154, similar to the preceding ones, for rotation about an axis perpendicular to the longitudinal axis of the ski and parallel to the plane of the ski, said rotation occurring against the action of first elastic means in form of a spring 155 operating by tension and acting between the base element 154 and the elongated element 151.

The second element embracing the metatarsus is in this case simply formed by an elastic band 156 connected at its ends to the two lateral portions of the base element 154. A plate-like element 157 similar to and achieving the same function as the previously described elements is connected in front of the base element 154. It may form a unitary body with the base element.

This embodiment of the binding allows forward bending of the skier's leg up to a rotation of 90° by overcoming the elasticity of the first elastic means 155 and with the displacement of the band 153 along the calf. In the case of torsion of the foot with respect to the leg, the elastic band 156 is eased, so that the recess provided on the sole of the ski boot may advance beyond the plate-like element 157 and thus release the foot from the binding.

Figure 10:
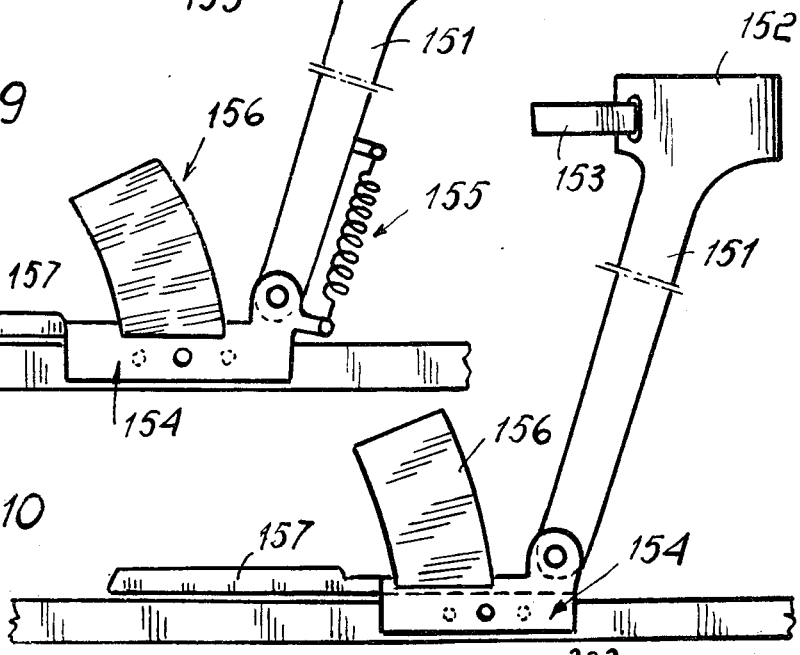
FIG. 10 is a diagrammatic representation of a seventh embodiment of a simplified type of binding.

The seventh embodiment described in FIG. 10 is completely analogous to the one described in FIG. 9, for which reason the same elements will be indicated on the drawing with the same reference numerals, with the only difference being that the elastic element which opposes the rotation between the first elongated element 151 and the base element 154 has not been provided. As for operation and the possibility of releasing the foot from the binding, there is no substantial difference with what has been previously mentioned.

Figure 11:
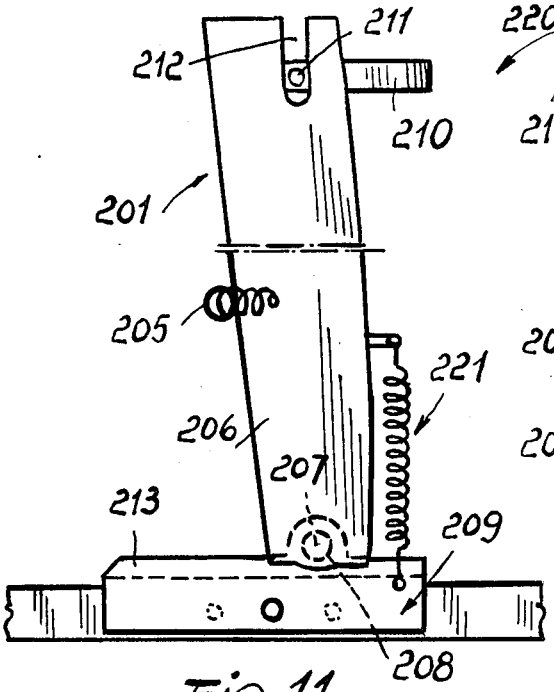
FIG. 11 represents an eighth embodiment of the binding according to the invention seen laterally.
Figure 12:
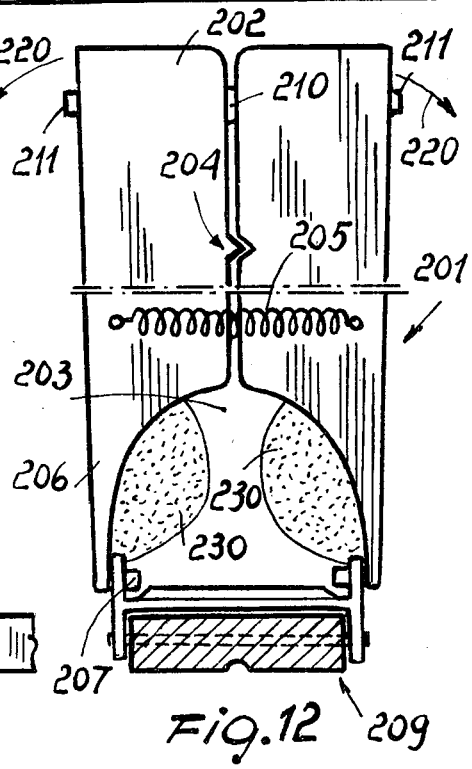
FIG. 12 is a frontal view of the binding of FIG. 11.

The eighth embodiment of the binding shown in FIGS. 11 and 12 has a first elongated element 201, consisting of two half-shells 202, extending vertically, mutually symmetrical and mating along a vertical centerline; the two half-shells 202 are shaped in such a manner as to involve the front and lateral portions of the skier's leg, while the front portion of the foot passes through an aperture 203 which is formed in the front lower section of the two half-shells 202 when drawn together. Along the mating line, the two half-shells 202 have each a notch and a seat, indicated overall by 204 having the function of preventing eventual displacements between the two half-shells along the mating line.

These two half-shells 202 are joined together elastically by means of a spring 205 or any other elastic element provided between them, preferably above the aperture 203 formed by them.

At the aperture 203, the two half-shells 202 have side panels 206 ending with a pair of opposing pins 207 which in their turn are rotatably engaged in holes 208 provided in a base element 209, similar to the preceding ones and attached to the ski in the manner previously described.

In this embodiment, the second element involving the metatarsus consists of a pair of bodies 230 made of elastically deformable material, provided inside said half-shells 202 on the side panels 206.

In addition the binding comprises an upper band 210 which may be attached to the calf of the skier's leg and which has a pair of opposing pins 211 which slidingly engage in slots 212, open upwards, provided on the upper extremity of said half-shells 202.

In the front portion of the base element 209 there is provided a plate-like element 213, similar to the preceding ones, having the function of engaging in a groove provided on the sole of the shoe.

In order to attach the binding according to the invention to the skier's leg, it is sufficient to overcome the elastic resistance of the spring 205 by separating the two half-shells 202 in the direction of the arrows 220 in FIG. 12, thus allowing the insertion of the skier's foot and leg in such a manner that the front portion of the foot passes through the aperture 203 and the leg is arranged along and between the half-shells 202. When the two half-shells 202 are released, the spring 205 causes them to adhere tightly to the leg and also compresses the bodies 230 made of elastically deformable material provided at the side panels 206 on the metatarsus of the foot, thus achieving a tight adhesion of the skier's foot to the ski.

In addition to the foregoing there are provided first elastic means 221 acting between the base element 209 and the elongated element 201, in the specific case the two half-shells 202, so as to elastically oppose the forward bending of the skier's leg. With the binding just described it is possible to forward bend the leg with respect to the foot by overcoming the elastic resistance of said elastic means 205, and also in case of a forward fall, it happens that the pins 211 provided on the upper band 210 slide in the slots 212 until they come out of them, thus releasing the calf from the binding. In the case of torsion of the foot with respect to the leg, it happens that the foot pushes laterally against the bodies made of elastically deformable material 230, which practically constitute the jaw elements which grasp the metatarsus, and this push causes the mutual separation of the two lateral sides 206 overcoming the action of the spring 205 joining the two half-shells 202; in this manner the two half-shells 202 open up and release the foot.

According to this embodiment, the first elongated element 201 is preferably made of plastic material having the proper rigidity required to protect the shin-bone from eventual transversal oscillations, the only oscillations permitted being those about the pins 207.

Figure 13:
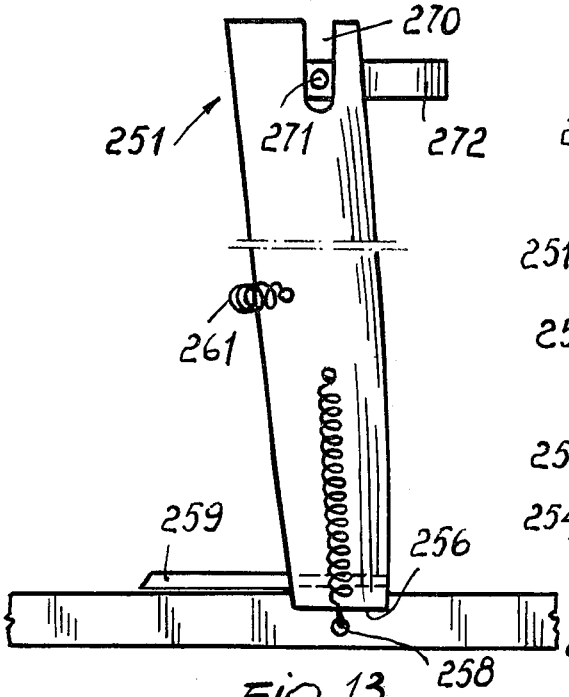
FIG. 13 is a diagrammatic representation of a ninth embodiment of the binding according to the invention seen laterally.
Figure 14:
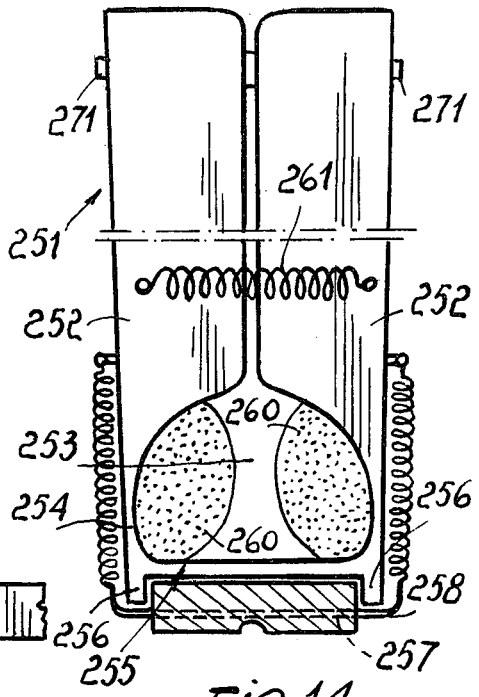
FIG. 14 is a frontal view of the binding of FIG. 13.

In the ninth embodiment shown in FIGS. 13 and 14, the binding comprises a first elongated body indicated overall at 251 consisting of a pair of half-shells 252 extending vertically, mutually symmetrical and mating along a vertical centerline. The shin-bone engages with the thus coupled half-shells 252, whereas the front part of the foot passes through an aperture 253 formed in the front lower portion of the half-shells 252 when drawn together. Laterally, in their lower portion, the two half-shells have two side panels 254 which are directly connected to the lateral portion of a base element 255 having side panels 256 which couple with the lateral edges of the ski. The base element 255 and therefore all the other elements forming a unitary body therewith is joined to the ski by means of a cable 258 passing through a transversal channel 257 provided through the neutral axis of the ski. Outside the transversal channel 257, the cable 258 extends parallel to the side panels 254 of the half-shells 252 and has elastic sections which maintain the base 255 and consequently the elongated element 251 elastically pressed against the ski.

In its front portion the base element 255 has a plate-like element 259 similar to the preceding ones and engaging with a corresponding recess provided on the sole of the skier's footwear.

The side panels 254 of the half-shells 252 house the second element involving the metatarsus of the skier which also in this case consists of blocks 260 of elastically deformable material which act upon the metatarsus by pushing the foot on the ski. Above the aperture 253 there are provided elastic joining means consisting, for example, of a spring 261, or any other elastic means, having the function of maintaining elastically joined the two half-shells. The half-shells 252 are provided with upper slots 270 for receiving opposing pins 271 provided on a band 272 which is applied to the calf of the skier.

The embodiment shown in FIGS. 13 and 14 allows forward rotation by overcoming the elasticity of the means 258, the rotation occurring about the front edge of the base element 255 and about an axis which is horizontal and perpendicular to the longitudinal axis of the ski. In the case of torsion it happens, as in the previously described case, that by overcoming the elastic force of the elastic joining element 261, the two half-shells 252 are caused to separate and therefore the foot is released from the binding without harm to the skier. Obviously in order to wear the binding described in FIGS. 13 and 14 the procedure described for wearing the binding illustrated in FIGS. 11 and 12 is followed.

Figure 15:
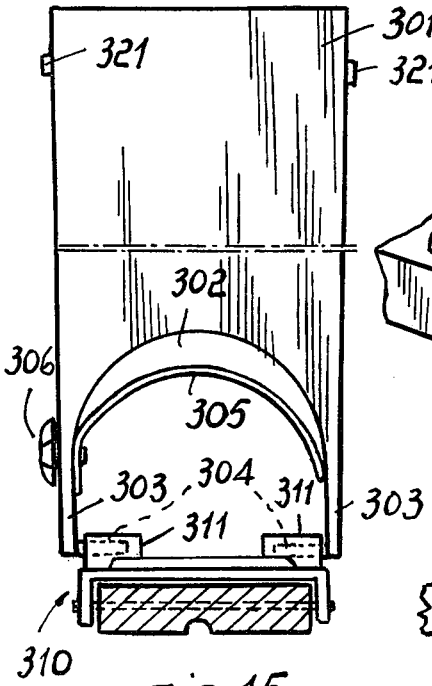
FIG. 15 is a diagrammatic representation, viewed frontally, of a tenth embodiment of the binding according to the invention.
Figure 17:
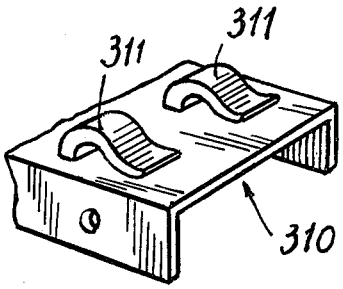
FIG. 17 is a detail of the binding of FIGS. 15 and 16.
Figure 16:
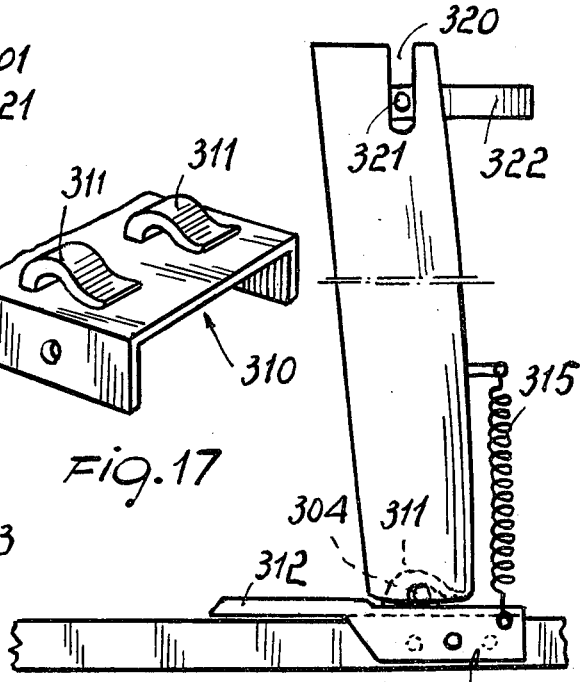
FIG. 16 is a lateral view of the binding of FIG. 15.

With reference to FIGS. 15 to 17, the tenth embodiment according to the invention comprises an elongated body 301, made of substantially rigid material and shaped so as to practically surround the skier's leg at the front and lateral portion of the shin-bone. At its lower front portion, the elongated body 301 is provided with an aperture 302 for the front part of the skier's foot. Two side panels 303, which are arranged along the lateral portions of the foot in the region of the metatarsus, are thus formed on the elongated element 301, in its lower portion, around the aperture 302. The free ends of these side panels 303 have a pair of opposing pins indicated by 304.

In the aperture 302, on the elongated body 301, there is provided a lower band 305, which tightly grasps the metatarsus of the foot and has the function of pushing the foot with a determined force against the ski. For this purpose, means 306 which tightly press the band 305 against the metatarsus may be provided.

The binding also comprises a base element 310, attached to the ski in the ways described previously, which has on its upper portion a pair of snap hooks 311 which engage with said pins 304 for joining the elongated element 301 to the base element 310. In front, said base element 310 is provided with a plate-like element 312, similar to the aforementioned ones, and which engages in a corresponding recess provided on the sole of the skier's shoe. In addition there are provided elastic means 315 acting between said base element 310 and the elongated body 301 with the function of elastically opposing the forward rotation of the leg about a horizontal axis perpendicular to the longitudinal axis of the ski, the axis of rotation in this case being defined by the pair of pins 306 engaging in the snap hooks 311.

The body 301 has a pair of upper slots 320 open upwards, which slidingly receive a pair of pins 321 provided on a band 322 which surrounds the calf of the skier's leg. With the described binding forward rotation is possible by overcoming the elastic action afforded by the elastic means 315 acting between the elongated body 301 and the base element 310.

In case of torsion of the foot with respect to the leg, it happens that the pins 304 come out of the snap hooks 311 provided on the base element 310, by rotation about a vertical axis thus releasing the skier's leg and avoiding harmful consequences.

In view of the foregoing description it is evident how the invention, in all its described embodiments attains the proposed objects and, particularly, it is emphasized that with the particular embodiment of the base element there is no stiffening of the ski and in addition, since it is connected to the ski through a channel provided on the neutral axis of the ski, it is not necessary to make any hole in the compressed layer of the ski, to attach the binding, thus not weakening the structure of the ski.

Another advantage consists in the fact that the binding, which eliminates the need for conventional ski boots, has an extremely reduced weight and bulk, is easily mounted and transportable, and in addition, in all its embodiments, is foldable on the ski in order to transport it with ease.

With the described bindings there is a considerable increase in safety while having drastically reduced the length of the binding. In traditional bindings in fact, the foot is grasped at the tip of the heel so that it offers a considerable leverage in the case of torsion. In the described cases, on the other hand, the foot is grasped only in the region of the metatarsus so that the lever arm that is formed in the case of torsion is extremely limited and thereby the skier is favored in that the possibility of breaking a limb is drastically reduced. Another advantage consists in the fact that the dependability of the disengagements is generally committed to the elasticity of the materials used thus eliminating mechanisms, which, in case of jamming would be extremely dangerous for the skier.

It should be observed that the described binding, in all its embodiments, allows in case of a forward fall, a rotation up to 90° about a horizontal axis perpendicular to the longitudinal axis of the ski. In the case of torsion of the foot with respect to the leg, when the moments exceed a predetermined value, it happens that the foot is released by the second element involving the metatarsus, except for the first binding described in which the rotating plate elastically follows the rotation of the rotating plate itself about a vertical pin.

Furthermore the effectiveness is considerably increased in the case of edging in that transversal oscillations of the shin-bone with respect to the foot and therefore with respect to the ski, are absolutely avoided. In conclusion, it is emphasized moreover that with the binding according to the invention, all the natural articulations of the foot and of the leg are exploited as much as possible in such a manner as to make skiing more natural. In addition to the foregoing all the elastic means mentioned in the description may consist of springs or any other suitable elastic means, and all the articulations between the various elements forming the binding, in addition to consisting of actual hinges, may be obtained by taking advantage of the flexibility and elasticity of the materials employed.

The invention thus conceived is susceptible to numerous modifications and variants, all falling within the scope of inventive concept.

Moreover all the details may be substituted by other technically equivalent elements or achieving the same function.

In practice, the materials employed as well as the dimensions may be any according to requirements.

I claim:

1. A ski binding comprising a base element for rigid connection to a ski, a rigid elongated element including a shaped portion at one end for at least partially enveloping a skier's leg at the shin-bone, said rigid elongated element being pivotally connected at the other end to said base element for rotation about an axis extending perpendicularly to the longitudinal axis of the ski and parallel to the plane of the ski, a second element connected to said base element in a position for embracing the metatarsus of the skier's foot and removably maintaining the sole of the skier's foot in contact with the ski, and a plate-like element rigid with said base element at the forward portion thereof, said plate-like element having a shaped upper surface for mating engagement with the sole of the skier's footwear.

2. A ski binding as claimed in claim 1, further including elastic means between said rigid elongated element and said base element opposing forward rotational movement of said rigid elongated element.

3. A ski binding as claimed in claim 1, in which said base element has two lateral portions for engagement with the lateral sides of the ski, said lateral portions each having a transverse through hole for receiving a locking rod passing through a transverse through hole provided in the ski at the neutral axis thereof for securing said lateral portions to the ski.

4. A ski binding as claimed in claim 1, in which said rigid elongated element is arranged laterally to the skier's leg for rotation in a plane parallel to the vertical plane of symmetry of the ski.

5. A ski binding as claimed in claim 1, in which said shaped portion of said rigid elongated element is provided with holes for receiving a strap embracing the skier's leg for securing the leg to said shaped portion.

6. A ski binding as claimed in claim 1, in which said plate-like element has a trapezoidal shape having the smaller base arranged facing the forward portion of the ski, said plate-like element having inclined lateral sides and grooves provided in the upper face of the plate-like element.

7. A ski binding as claimed in claim 1, in which said second element is pivotally connected to said base element for rotation about an axis extending transverse to the longitudinal axis of the ski and parallel to the plane of the ski, said axis passing close to the big toe articulation of the skier's foot, and in which a first elastic means is arranged between said rigid elongated element and said base element for opposing forward rotational movement of said rigid elongated element, and a second elastic means is arranged between said second element and said base element for pressing said second element towards the foot of the skier.

8. A ski binding as claimed in claim 1, in which said second element consists of an elastic band involving the metatarsus of the skier's foot and connected at its ends to lateral portions of said base element secured to the ski.

9. A ski binding as claimed in claim 1, in which said plate-like element forms a unitary body with said base element.

* * * * *